US007334289B2

(12) United States Patent
Kim et al.

(10) Patent No.: US 7,334,289 B2
(45) Date of Patent: Feb. 26, 2008

(54) LUBRICANT CLEANSING APPARATUS FOR DRY-TYPE WIRE DRAWING

(75) Inventors: Seon-tae Kim, Gangseo-gu (KR); Jeong-ho Kim, Yongin-si (KR); Tae-jung Lee, Suwon-si (KR)

(73) Assignee: LG Cable Ltd., Seoul (KR)

( * ) Notice: Subject to any disclaimer, the term of this patent is extended or adjusted under 35 U.S.C. 154(b) by 581 days.

(21) Appl. No.: 10/916,843

(22) Filed: Aug. 12, 2004

(65) Prior Publication Data

US 2005/0198762 A1 Sep. 15, 2005

(30) Foreign Application Priority Data

Mar. 12, 2004 (KR) ..... 10-2004-0016994

(51) Int. Cl.
*B08B 1/04* (2006.01)
*B08B 1/02* (2006.01)

(52) U.S. Cl. ..... 15/308; 15/309.1; 15/316.1; 15/88; 15/104.04

(58) Field of Classification Search ..... 15/308, 15/309.1, 316.1, 88 X, 88.2, 88.3, 104.04 X
See application file for complete search history.

(56) References Cited

U.S. PATENT DOCUMENTS 2,260,783 A * 10/1941 Morley ..... 15/88
3,116,811 A * 1/1964 Stevenson ..... 15/88
3,442,706 A * 5/1969 Derrick ..... 15/88
3,477,081 A * 11/1969 Schmidt ..... 15/88
3,530,526 A * 9/1970 Schmidt ..... 15/88
4,391,016 A * 7/1983 Kawamura et al. ..... 15/88
4,665,657 A * 5/1987 Rands et al. ..... 15/88
5,056,185 A * 10/1991 Schotter ..... 15/308

FOREIGN PATENT DOCUMENTS

| | | |
|---|---|---|
| JP | 10280178 | 10/1998 |
| JP | 11123440 | 5/1999 |
| JP | 2002012991 | 1/2002 |
| JP | KR1020030039021 | 5/2003 |

* cited by examiner

*Primary Examiner*—Theresa T. Snider
(74) *Attorney, Agent, or Firm*—John P. White; Cooper & Dunham LLP

(57) ABSTRACT

Disclosed herein is an apparatus for cleaning a lubricant for dry-type wire drawing. The apparatus comprises a case provided with a cover and piercing holes at opposite sides of the case such that a steel wire can pass through the case, a plurality of driving motors provided at one side of the exterior of the case, rotating members located at an inside of the case and connected to the driving motors, respectively, by belts serving to rotate them, support plates for supporting the rotating members, and cleaning members coupled to the rotating member and adapted to provide a path through which the steel wire passes. The dry lubricant on the surface of the steel wire can be effectively cleaned by friction between the lubricant on the steel wire and the cleaning members.

7 Claims, 2 Drawing Sheets

LUBRICANT CLEANSING APPARATUS FOR DRY-TYPE WIRE DRAWING

BACKGROUND OF THE INVENTION

1. Field of the Invention

The present invention relates to an apparatus for cleaning a lubricant for dry type wire drawing, and more particularly to an apparatus for cleaning a lubricant for dry type wire drawing, which can effectively remove a lubricant remaining on a surface of a steel wire or an aluminum clad wire for power lines.

2. Description of the Related Art

Generally, an aluminum clad steel wire (AW) for power lines is provided in such a form that a steel wire has an aluminum cladding on its surface, whereby the steel wire inside of the aluminum clad steel wire acts to increase the tensile strength of the steel rod and the aluminum cladding on the surface of the steel rod mainly act as an electric conductor.

Several aluminum clad steel wires are stranded and used for aerial cables, which are power lines for high voltage transmission.

As for one of conventional methods of applying the aluminum cladding on the surface of the steel wire, a continuous extrusion method is used. The aluminum clad steel wire produced by the continuous extrusion method is drawn into a steel wire having a desired diameter according to the diameter of the steel wire through several steps of a wire drawing process.

Generally, the wire drawing method can be classified into a wet type wire drawing method and a dry type wire drawing method.

First, the wet type wire drawing method is performed such that a steel rod is drawn by passing through a wire drawing die in a state that pressure is applied to a lubricant in a liquid state with a pressure die. Thus, when a weak pressure is applied to the lubricant, the dies are easily broken.

Further, it is difficult to keep the pressure of the lubricant in a predetermined state using the pressure die, and the wet type wire drawing method is mainly used for low speed wire drawing.

Compared with the wet type wire drawing method, the dry-type wire drawing method uses a lubricant comprising soap components (KaOH+NaOH) not in a liquid state but in a solid state. Thus, it is easy to apply pressure to the lubricant and to keep the pressure of the lubricant in a predetermined state due to the solid lubricant. Thus, since the dies are not broken during high-speed wire drawing, this method is widely used for high-speed wire drawing at around 400 mpm.

Specifically, the lubricant for the dry type wire drawing generally comprises the soap components mixed in a particular ratio for the wire drawing. The soap components comprise KaOH and NaOH mixed in a predetermined ratio.

The lubricant of the soap components consists of particles of a predetermined size. Specifically, the particle has a size of dozens of microns to several millimeters.

In general, prior to the wire drawing, a main lubrication system is operated in such a manner that as the wire material passing through the lubricant container advances, the lubricant is moved by a force attributed to friction between the wire material and the dry lubricant applied to the surface of the material.

As a result, the lubricant on the wire material is mainly accumulated at an outlet of the lubricant container along with the surface of the wire material, that is, at an inlet of the pressure die or the wire drawing die. Then, a part of the accumulated lubricant passes through the inside of the die, such as a reduction part and a bearing part of the die, along with the wire material, minimizing the friction between the material and the die.

After wire drawing, although it does not always happen, the lubricant often remains in some quantity on the surface of the wire material, causing scattering of the lubricant during post processing, such as strand processing, resulting in the environment contamination.

As for a method of removing the lubricant for the conventional AW dry-type wire drawing, there are various methods as follows.

One of the methods uses some pieces of cloth for cleaning the lubricant. By the method, after the wire drawing is finished, the wire material passes through the center of the pieces of the cloth heaped in place to form many folds so that the lubricant can be naturally cleaned.

Another method uses water for cleaning the lubricant. As the method using the water, there have been suggested a manner wherein the lubricant can be naturally cleaned mainly with warm water while the wire material passes through the warm water bath, a manner wherein the lubricant is cleaned by water injected at a high pressure through a nozzle, a manner of cleaning the lubricant with a rotating brush, or the like.

Among the conventional methods of cleaning the lubricant for the dry-type wire drawing, the method using the pieces of cloth has problems in that although this method can be applied to the low speed wire drawing, when the wire drawing is performed at 400 mpm or more, the cleaning is minimally carried out and the pieces of cloth must be frequently replaced with a new cloth.

In case of the method of cleaning the lubricant in the warm water bath, there occurs no problem when wire drawing at a low speed. However, in case of the high speed wire drawing of 400 mpm or more, cleaning is not adequately carried out and the water bath should be made to have a length of 5 m~10 m. Further, even if the long water bath is provided, it frequently happens that cleaning is not perfectly carried out.

The methods using the high-pressure injection nozzle and the rotating brush have problems in that cleaning is not adequately carried out and that the cleaning water is easily polluted due to adhering of the lubricant to the cleaning water, so that supply and drainage paths can be blocked by the polluted cleaning water.

SUMMARY OF THE INVENTION

The present invention has been made to solve the above problems, and it is an object of the present invention to provide an apparatus for cleaning a lubricant for dry-type wire drawing, which can easily and perfectly remove the dry lubricant remaining on a surface of a wire material in an easy and inexpensive manner even in case of a high speed wire drawing of 400 mpm or more, thereby ensuring a minimization of scattering of the lubricant to the surrounding atmosphere and a stable operation during post processing in order to reduce environmental contamination.

In accordance with an aspect of the present invention, the above and other objects can be accomplished by the provision of an apparatus for cleaning a lubricant for dry-type wire drawing, comprising: a case provided with a cover and formed with piercing holes at opposite sides of the case such that a steel wire can pass through the case; a plurality of driving motors provided at one side of the exterior of the case; rotating members located inside the case and connected to the driving motors corresponding to the rotating members, respectively, by a belt serving to rotate them; support plates for supporting the rotating members; and cleaning members coupled to the rotating members and forming a path through which the steel wire passes.

The apparatus for cleaning the lubricant rapidly removes the lubricant remaining on the steel wire during the high speed wire drawing process, and prevents the removed solid lubricant from being discharged, thereby preventing environment contamination.

BRIEF DESCRIPTION OF THE DRAWINGS

The foregoing and other objects and features of the present invention will be more clearly understood from the following detailed description taken in conjunction with the accompanying drawings, in which.

DESCRIPTION OF THE PREFERRED EMBODIMENTS

Preferred embodiments of the present invention will now be described in detail with reference to the accompanying drawings.

Figure 1:
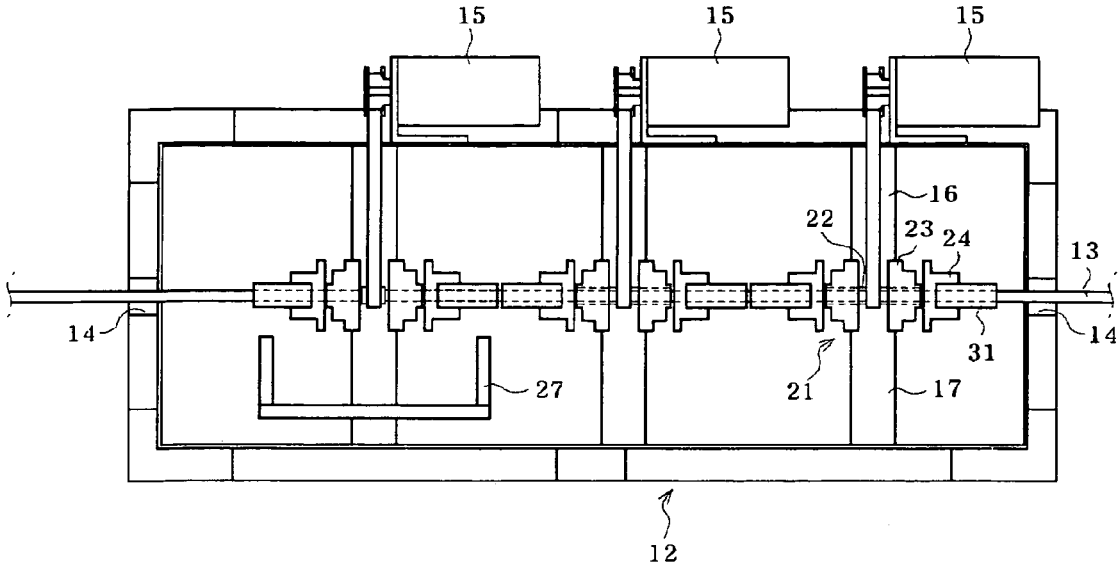
FIG. 1 is a view illustrating an apparatus for cleaning a lubricant for dry type wire drawing according to the present invention.
Figure 2:
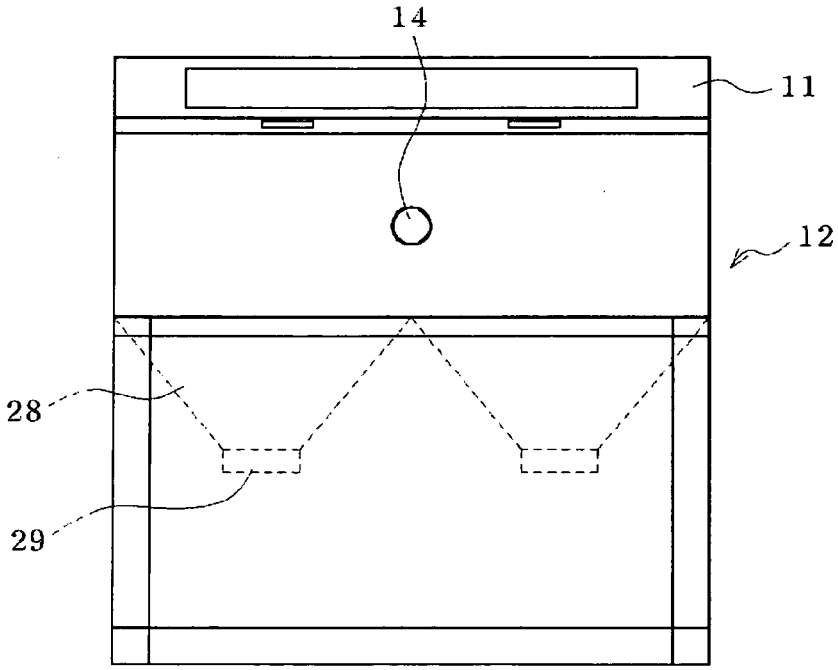
FIG. 2 is a section side elevation of the apparatus of FIG. 1.
Figure 3:
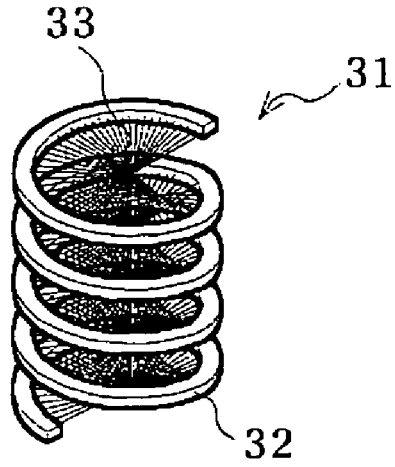
FIG. 3 is a view illustrating a cleaning member of the apparatus of FIG. 1.
Figure 4:
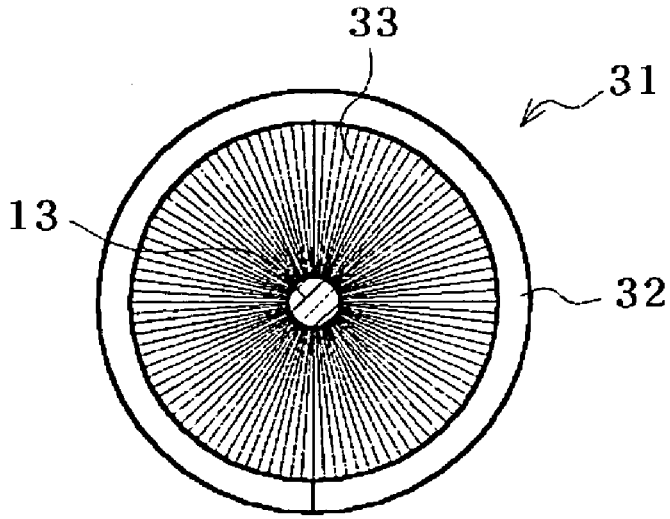
FIG. 4 is a cross sectional view of the cleaning member of FIG. 1.

FIG. 1 is a view illustrating an apparatus for cleaning a lubricant for dry type wire drawing according to the present invention, and FIG. 2 is a sectional side elevation of the apparatus of FIG. 1. FIG. 3 is a view illustrating a cleaning member of the apparatus of FIG. 1, and FIG. 4 is a cross sectional view of the cleaning member of FIG. 1.

As shown in the drawings, the apparatus of the present invention is provided with a case 12 and a cover provided at an upper portion of the case 12 for opening and closing the case 12. The case 12 is formed with piercing holes 14 at opposite sides of the case 12 such that a steel wire 13 can pass through the case 12.

The case 12 is equipped with a plurality of driving motors 15 spaced apart from one by one by a predetermined distance at one side of the exterior of the case 12. Inside of the case 12, there are provided rotating members 21 corresponding to the driving motors, respectively. The rotating members 21 are connected to the driving motors 15 by belts 16 serving to rotate the rotating members 21.

The rotating members 21 are respectively supported at a lower end thereof by support plates 17 fixed to the case 12, and formed with cleaning members 31 such that the steel wire 13 can pass through the cleaning members 31.

Here, each of the rotating members 21 rotated by the belt 16 may comprise a rotational shaft 22 having a cylindrical shape such that the steel wire 13 can pass therethrough, a pair of fixtures 23 fixed to the support plate 17 to hold driving of the rotational shaft 22 and provided with bearings therein such that the rotational shaft 22 passing through the fixtures 23 can rotate in the fixtures, and a pair of joints 24 oppositely arranged at the sides of the fixtures 23 such that the joints 24 are coupled to the rotational shaft 22 to rotate together with the shaft. The joints 24 are respectively formed with grooves into which the cleaning members are fitted.

The joints 24 may be structured such that the cleaning members 31 can be detachably fitted thereto to allow cleaning and replacement of the cleaning members 31.

The number of the cleaning members 31 depends on the size and drawing speed of the steel wire 13. The cleaning members may be inserted into the piercing holes 14 of the case 12 in order to perform cleaning.

Meanwhile, each of the cleaning members 31 consists of a spiral-shaped frame 32 and a plurality of gray yarns 33 fixed inside of the frame 32, overlapping each other therein, such that when the steel wire 13 passes through the cleaning member 31, the lubricant can be removed by friction between the gray yarns and the steel wire.

The spiral-shaped frame 32 preferably has a pitch within 20~60% of the outer diameter of the frame.

Further, as for a material of the gray yarns, Nylon 66 is preferred. The gray yarns preferably have a length greater than the inner diameter of the spiral-shaped frame 32 and smaller than the inner diameter ±5 mm of the spiral-shaped frame 32. Of course, the gray yarns may have the same length as that of the inner diameter of the frame 32.

The case 12 is provided with one or more blowers 27 for blowing air in order to clean the lubricant remaining on the respective cleaning member 31 and with collecting plates 28 for collecting the lubricant scattered by the blowers 27 at a lower portion of the case 12.

Each of the collecting plates converges downward to form a convergent hole 29 at the lower end of the collecting plate. The convergent hole 29 may be equipped with a dust collector (not shown).

Operation of the apparatus according to the present invention and advantageous effects thereof will now be described.

When the steel wire 13 having a lubricant on its surface is passed through the case at a high speed, the rotating members 21 driven by the driving motors 15 are rotated, so that the cleaning members 31 coupled to the joints of the rotating members 21 clean the outer peripheral surface of the steel wire 13 while rotating.

That is, when the steel wire 13 passes through the cleaning members 31, the plurality of the gray yarns 33 rotating at a high speed in each cleaning member contact the steel wire 13, cleaning the lubricant on the surface of the steel wire 13.

Meanwhile, as the process for cleaning the lubricant is performed for long periods of time, the lubricant is adhered to the gray yarns 33, so that cleaning efficiency can be lowered. With regard to this, the blower 27 blows air to remove the lubricant adhered to the gray yarns 33.

Then, the scattered lubricant is accumulated at the lower end of the case 12 through the collecting plates 28 of the case 12. Here, the collector (not shown) connected to the convergent holes 29 of the collecting plates 28 can act to collect the lubricant.

The cover 11 of the case 12 prevents environmental contamination by preventing scattering of the lubricant occurring not only during the process of cleaning the lubricant but also during the process of washing the gray yarns 33.

As apparent from the description, according to the present invention, there is an advantageous effect in that when using the apparatus of the present invention, the lubricant on the surface of the steel wire can be effectively cleaned by the friction between the lubricant for the wire drawing and the steel wire, which is caused by the rotation of the gray yarns.

There is another advantageous effect in that the dry lubricant can be completely removed from the surface of the steel wire even in case of a high-speed wire drawing of 400 mpm or more.

There is another advantageous effect in that since the dry lubricant can be removed from the surface of the steel wire not only by the rotational movement of the cleaning members but also by the blower, the cleaning members can be used for long periods of time.

There is yet another advantageous effect in that the case at the upper portion of the case and the means for collecting the dry lubricant removed from the steel wire or from the gray yarns prevents the lubricant from scattering and prevent environmental contamination.

It should be understood that the embodiments and the accompanying drawings as described above have been described for illustrative purposes and the present invention is limited by the following claims. Further, those skilled in the art will appreciate that various modifications, additions and substitutions are allowed without departing from the scope and spirit of the invention as set forth in the accompanying claims.

What is claimed is:

1. An apparatus for cleaning a lubricant for dry-type wire drawing, comprising:

a case provided with a cover and piercing holes at opposite sides of the case such that a steel wire passes through the case;

a plurality of driving motors provided at one side of the exterior of the case;

rotating members located inside the case, and connected to the driving motors corresponding to the rotating members, respectively, by belts serving to rotate them;

support plates for supporting the rotating members; and cleaning members coupled to the rotating member and adapted to provide a path through which the steel wire passes, wherein each of the cleaning members comprises a spiral-shaped frame and a plurality of gray yarns fixed inside of the frame.

2. The apparatus as set forth in claim 1, wherein the case is provided with one or more blowers for blowing air onto the cleaning member and with collecting plates for collecting the lubricant scattered by the blowers at a lower portion of the case.

3. The apparatus as set forth in claim 1, wherein each of the rotating members comprises:

a rotational shaft connected to the belt and rotated by the belt;

a pair of fixtures fixed to the support plate and adapted to allow the rotational shaft passing through the fixtures to rotate in the fixtures; and joints respectively formed with grooves into which the cleaning members are inserted, and oppositely arranged at the sides of the fixtures such that the joints are coupled to the rotational shaft to rotate together with the rotational shaft.

4. The apparatus as set forth in claim 1, wherein the spiral-shaped frame has a pitch within 20~60% of an outer diameter of the frame.

5. The apparatus as set forth in claim 1, wherein the gray yarns are made of Nylon 66.

6. The apparatus as set forth in claim 5, wherein the gray yarns have a length greater than an inner diameter of the spiral-shaped frame and smaller than the inner diameter +5 mm of the spiral-shaped frame.

7. The apparatus as set forth in claim 1, wherein the gray yarns have a length greater than an inner diameter of the spiral-shaped frame and smaller than the inner diameter +5 mm of the spiral-shaped frame.

* * * * *